US006710696B2

(12) United States Patent
Meiners et al.

(10) Patent No.: US 6,710,696 B2
(45) Date of Patent: Mar. 23, 2004

(54) FUSE HOUSING FOR NETWORK PROTECTOR

(75) Inventors: Steven E. Meiners, Greenwood, SC (US); Arthur J. Jur, Aliquippa, PA (US); Stephen W. Oneufers, Cranberry Township, PA (US); Douglas M. Brandt, Ellwood City, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/116,954

(22) Filed: Apr. 8, 2002

(65) Prior Publication Data

US 2003/0189479 A1 Oct. 9, 2003

(51) Int. Cl.[7] ..... H01H 85/02; H01H 85/47

(52) U.S. Cl. ..... 337/186; 337/187; 361/626

(58) Field of Search ..... 337/186, 187, 337/191, 227; 361/104, 626, 837

(56) References Cited

U.S. PATENT DOCUMENTS 3,043,934 A * 7/1962 Bodenschatz ..... 337/7
3,171,926 A * 3/1965 Schwab ..... 337/7
3,710,295 A * 1/1973 Staub et al. ..... 337/166
3,810,063 A * 5/1974 Blewitt ..... 337/166
3,818,409 A * 6/1974 Pastors et al. ..... 337/273
3,983,460 A 9/1976 Kuhn et al.
3,991,291 A * 11/1976 McGuffie et al. ..... 200/50.02
4,050,045 A * 9/1977 Motten et al. ..... 337/187
4,216,456 A * 8/1980 Hotta et al. ..... 337/114
6,275,135 B1 * 8/2001 Hibayashi et al. ..... 337/227
6,294,978 B1 * 9/2001 Endo et al. ..... 337/166
6,448,882 B1 * 9/2002 Inaba et al. ..... 337/227
6,456,188 B1 * 9/2002 Tsuchiya ..... 337/235
6,509,824 B2 * 1/2003 Inaba et al. ..... 337/295
6,512,443 B1 * 1/2003 Matsumura et al. ..... 337/189

* cited by examiner

*Primary Examiner*—Anatoly Vortman
(74) *Attorney, Agent, or Firm*—Martin J. Moran

(57) ABSTRACT

An improved fuse housing includes a main body and a cover and is configured to receive a fuse. The main body includes a plurality of fins that are configured to increase the surface area of the fuse housing in order to enhance heat dissipation. The main body is formed with a cavity for the fuse and a pair of conductors extending between the interior of the fuse housing and the exterior thereof for connection with the fuse. The cavity is configured to minimize the quantity of air between the fuse and the fuse housing to facilitates heat transfer. Each conductor includes excess studs for connection with the fuse to enhance heat conduction from the fuse. The cover is fastened to the main body with sufficient fasteners to permit the cover to be a stressed member to resist fracturing of the fuse housing from magnetic and other forces from the conductors.

2 Claims, 4 Drawing Sheets

FUSE HOUSING FOR NETWORK PROTECTOR

BACKGROUND OF THE INVENTION

1. Field of the Invention

The present invention relates generally to power distribution equipment and, more particularly, to circuit interrupters with fuse protection.

2. Description of the Related Art

Two primary objectives of the electric utility industry in the delivery of electrical power are safety and reliability. Since the late 1920s, AC secondary network systems have been used in certain locations such as downtown business districts and commercial areas in order to provide a high degree of service continuity. In such an AC secondary network system, a plurality of secondary mains surround the area being served, such as a city block, and are connected with one another to form a secondary network grid at low voltage to which the customer loads are connected.

Electrical power is supplied to the secondary network by a plurality of high voltage transmission lines. Each high voltage transmission line delivers power to the network through network transformers. The transformers reduce the high voltage from the transmission lines to a lower voltage suitable for distribution to the customers.

In such secondary network systems, a failure of any one transmission line will not result in an interruption of service to the customers since electrical power will be supplied to the customers over the remaining transmission lines. When a failure or fault occurs in a high voltage transmission line or in one of its associated network transformers, the station end of the transmission line, that is, the end of the transmission line closest to the generating station, is disconnected from the system by opening a feeder circuit breaker. In addition, it is necessary that all of the network transformers on the failed transmission line be disconnected from the secondary network by some type of protective device to prevent power from the secondary network from being fed back through the network transformers to the fault. The protective device used for such purpose is the network protector.

The network protector consists of a specially designed circuit breaker with a closing and opening mechanism that is controlled by a relay. When the network protector is closed, the relay operates to trip the network protector upon a reversal of power flow. The relay acts to close the network protector when, and only when, the proper voltage conditions exist across the network protector.

Network protectors typically have been located outdoors either above ground or below ground and thus have been protected by a sealed enclosure. When a network protector is approached for maintenance, testing, or repair, the network protector must be electrically and physically disconnected from the power distribution equipment on both the network transformer side and the secondary network side. Historically, this consideration dictated the use of a rollout-type or draw-out-type circuit breaker which could be disconnected and rolled out of its enclosure for maintenance, testing, and repair.

Network protectors typically have additionally included fuses on each phase between the circuit breaker and the network transformer or between the circuit breaker and the network. Such fuses have been provided as a backup current interruption device that operates in the event of a failure of the circuit breaker. The fuses extending between the circuit breaker and the secondary network typically have either each been disposed in separate fuse housings that are disposed at the exterior of the sealed enclosure or been disposed internally within the sealed enclosure within which the circuit breaker is disposed. Such fuse housings typically have been molded out of an insulative material such as epoxy and include a cover which, when in place, seals the fuse within the fuse housing. While such fuse housings have been generally effective for their intended purposes, such fuse housings have not, however, been without limitations.

It is known that fuses generate heat during operation, and such heat must be dissipated through the fuse housing to the surrounding atmosphere. It is known that the heat generated by a fuse increases quadratically with the current passing through the fuse. As such, the heat dissipation characteristics of the fuse housings have limited the current-carrying capability of the fuses disposed within the housings. It is thus desired to provide an improved fuse housing having improved heat dissipation characteristics which permits a fuse disposed within the improved fuse housing to be employed in relatively higher current carrying applications than was previously possible.

Previously known fuse housings have included a pair of conductors extending from the interior of the fuse housing to the exterior thereof to permit the fuse to be connected between the circuit breaker and the network. At elevated current levels, particularly at fault current levels, the magnetic fields generated around such conductors can result in significant forces being applied to the conductors when the conductors of different phases are disposed closely adjacent one another. Such forces on the conductors have been known to fracture the fuse housings. It is thus desired to provide an improved fuse housing that is resistant to such fracturing due to forces from the conductors.

SUMMARY OF THE INVENTION

Accordingly, an improved fuse housing includes a main body and a cover and is configured to receive a fuse therein. The main body includes a plurality of fins that are configured to increase the surface area of the fuse housing in order to enhance the heat dissipative characteristics of the fuse housing. The main body is formed with a cavity within which the fuse can be disposed, and further includes a pair of conductors extending between the interior of the fuse housing and the exterior thereof that are connectable with the fuse. The cavity is configured to minimize the quantity of insulative air between the fuse and the fuse housing, which facilitates the transfer of heat from the fuse to the fuse housing and thus to the atmosphere. Each of the conductors includes an excess quantity of studs for connection with the fuse in order to enhance the conduction of heat away from the fuse. The cover is fastened to the main body with a sufficient number of fasteners to permit the cover to be a stressed member and to help resist fracturing of the fuse housing due to magnetic and other forces applied by the conductors.

As such, an aspect of the present invention is to provide an improved fuse housing that can be employed in conjunction with a network protector or other electrical device.

Another aspect of the present invention is to provide an improved fuse housing having enhanced heat dissipation characteristics.

Another aspect of the present invention is to provide an improved fuse housing having a plurality of fins formed thereon.

Another aspect of the present invention is to provide an improved fuse housing having a main body that is formed to include a cavity that is configured to receive a fuse therein, with the cavity being configured to minimize the quantity of insulative air between the fuse and the main body.

Another aspect of the present invention is to provide an improved fuse housing having a pair of conductors, wherein the conductors each include an excess number of fasteners for connection with a fuse to enhance the conduction of heat from the fuse to the conductors.

Another aspect of the present invention is to provide an improved fuse housing having a main body and a cover, in which the cover is securely fastened to the main body with a sufficient number of fasteners that the cover can become a stressed member and resist the fuse housing from fracture upon the application of forces thereto.

Accordingly, an aspect of the present invention is to provide a fuse housing that is structured to receive a fuse, in which the general nature of the fuse housing can be stated as including a main body, the main body including at least a first fin, the at least first fin being structured to dissipate heat from the fuse housing to the atmosphere, the main body being formed with a cavity, a first conductor, a second conductor, a cover, the cover being disposed over the cavity, and the cavity being structured to receive therein the fuse in electrically conductive engagement with the first and second conductors.

Another aspect of the present invention is to provide a current interrupter, the general nature of which can be stated as including a fuse housing, the fuse housing including a main body, the main body including at least a first fin, the at least first fin being structured to dissipate heat from the fuse housing to the atmosphere, the main body being formed with a cavity, a first conductor, a second conductor, a fuse, the fuse being disposed in the cavity, the fuse being electrically conductively engaged with the first conductor, the fuse being electrically conductively engaged with the second conductor, a cover, and the cover being disposed over the cavity.

Another aspect of the present invention is to provide a network protector, the general nature of which can be stated as including an enclosure, first current interruption means disposed internally within the enclosure, second current interruption means disposed externally to the enclosure, the second current interruption means including a fuse, the second current interruption means including a fuse housing, the fuse housing including a main body, the main body including at least a first fin, the at least first fin being structured to dissipate heat from the fuse housing to the atmosphere, the fuse housing including a first conductor, the fuse housing including a second conductor, the fuse being electrically conductively engaged with the first conductor, the fuse being electrically conductively engaged with the second conductor, the main body being formed with a cavity, the fuse being disposed in the cavity, the fuse housing including a cover, and the cover being disposed over the cavity.

BRIEF DESCRIPTION OF THE DRAWINGS

A further understanding of the invention can be gained from the following description of the preferred embodiment when read in conjunction with the accompanying drawings in which.

Similar numerals refer similar to parts throughout the specification.

DESCRIPTION OF THE PREFERRED EMBODIMENT

Figure 1:
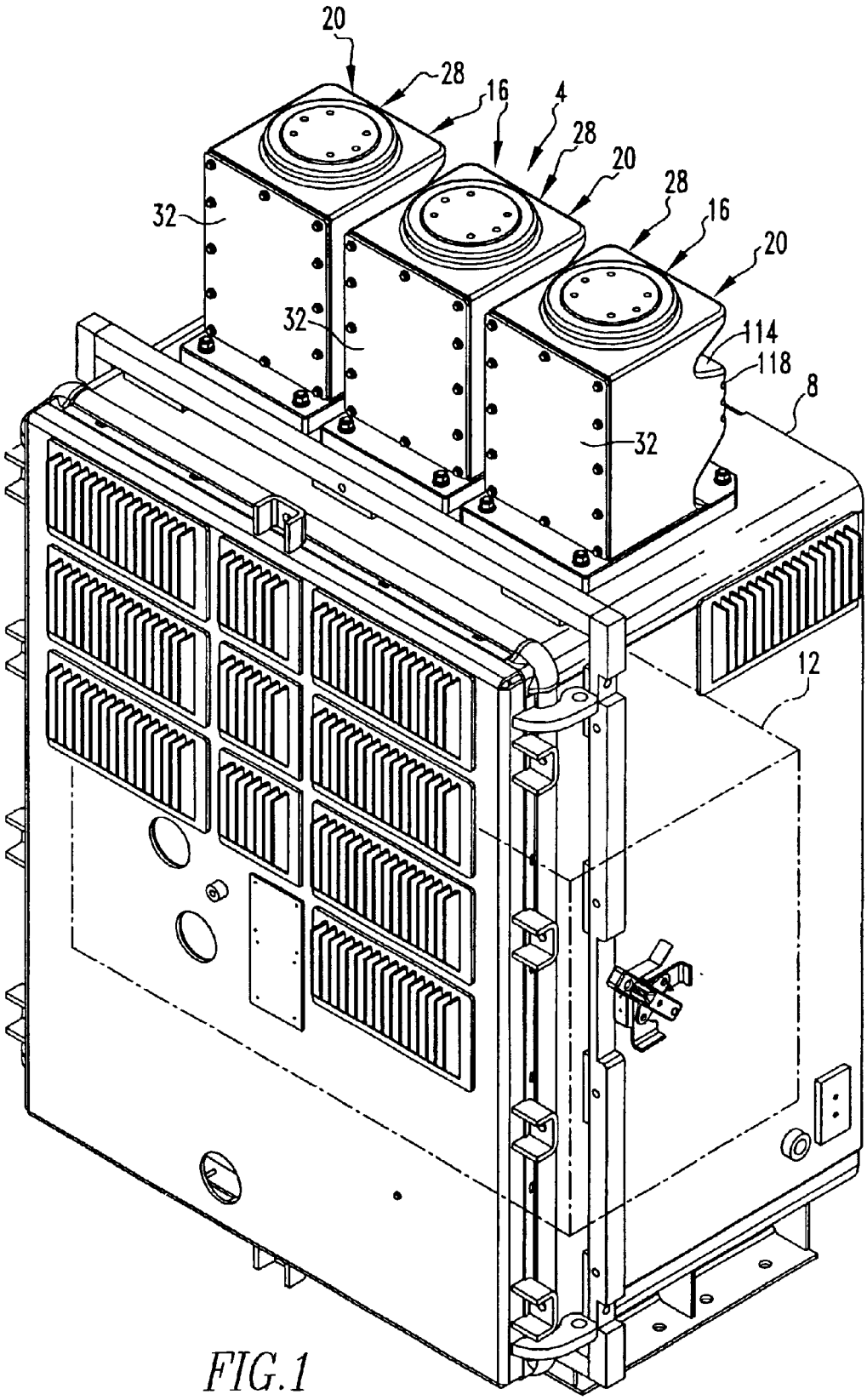
FIG. 1 is an isometric view of an improved network protector in accordance with the present invention that includes an improved current interruption device in accordance with the present invention.

An improved network protector 4 is indicated generally in FIG. 1. The network protector 4 generally includes an enclosure 8, a circuit breaker 12, and a plurality of current interrupters 16. The network protector 4 extends between a bank of network transformers (not shown) that are connected with a transmission line (not shown) and a secondary network grid (not shown) that is connected with a plurality of consumer electrical loads (not shown). The network protector 4 is configured to resist the transmission of excess quantities of electrical power therethrough in the event of a fault. The circuit breaker 12 and the current interrupters 16 each function as current interruption means which are configured to interrupt current flowing therethrough under certain specified circumstances.

The enclosure 8 is a substantially waterproof container that can receive the circuit breaker 12 therein. The circuit breaker 12 is a specially configured device that is electrically connected with other electrical components including a master relay (not specifically shown) and a phase relay (not specifically shown) that control the operation of the circuit breaker 12 in a known fashion. The circuit breaker 12 is of a rollout design but may be of other designs without departing from the concept of the present invention. While the circuit breaker 12 is disposed internally within the enclosure 8, the current interrupters 16 are disposed externally to the enclosure 8.

Figure 2:
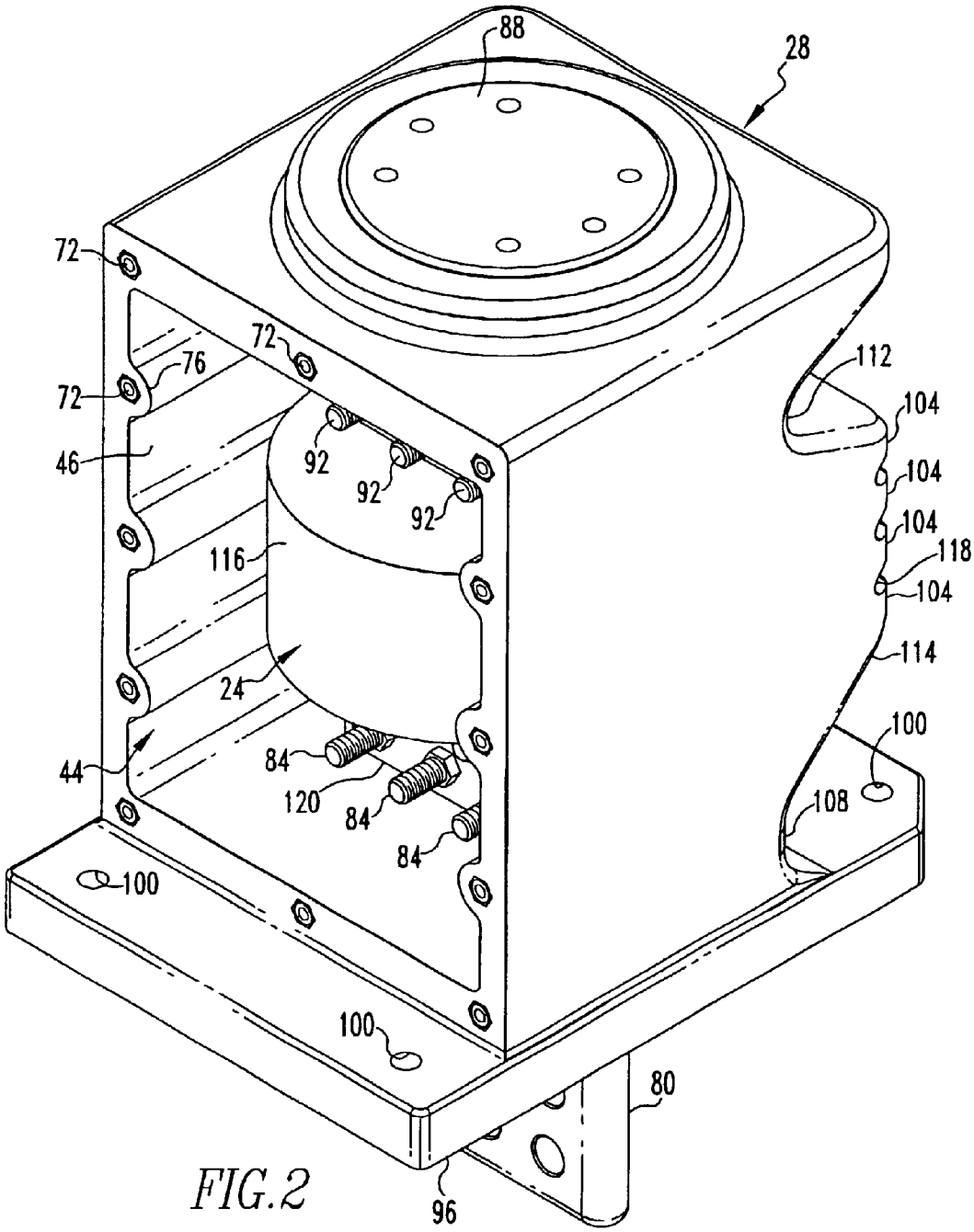
FIG. 2 is an isometric view of a portion of the current interruption device.
Figure 3:
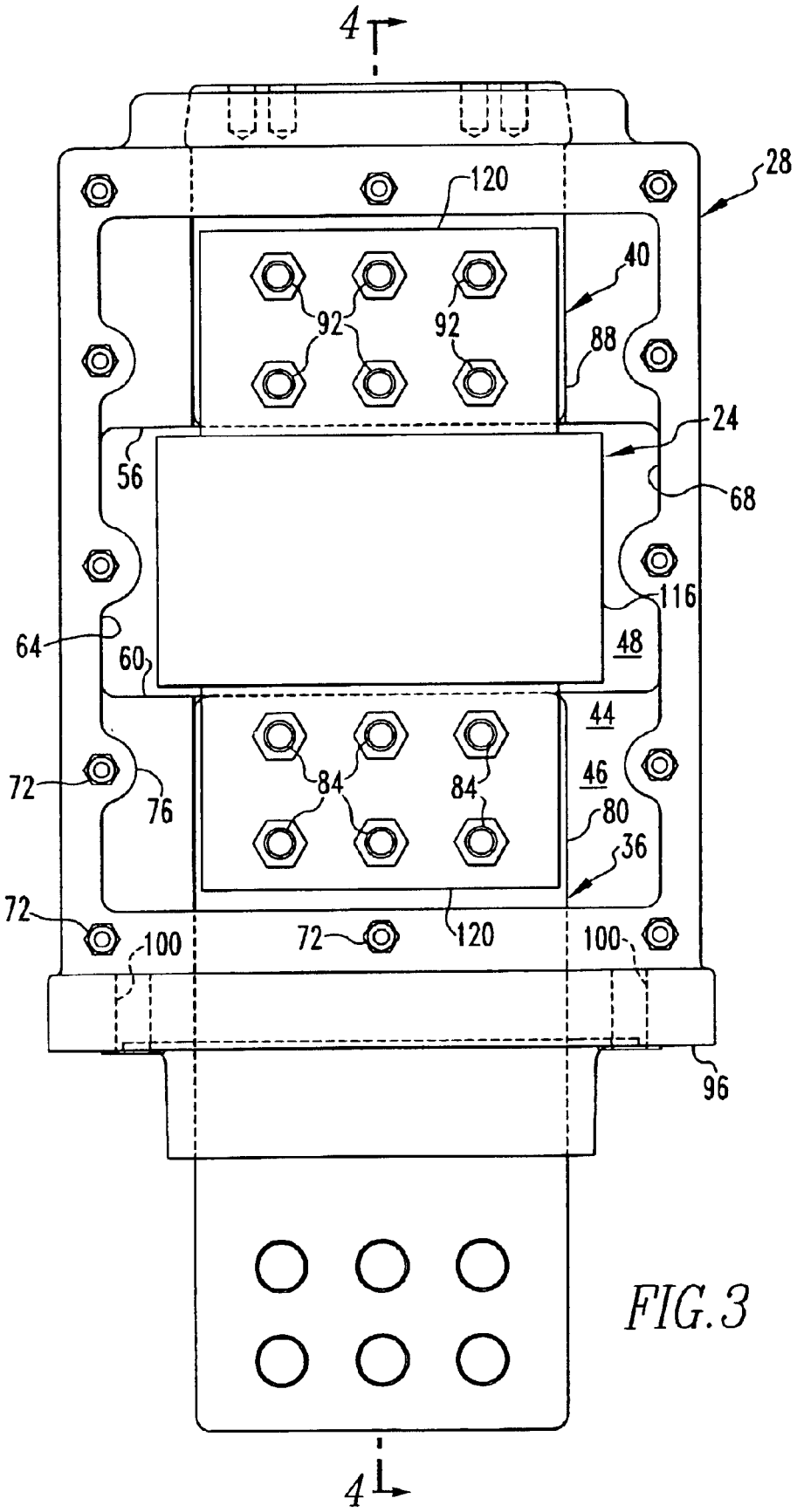
FIG. 3 is a front elevational view of a portion of the current interruption device.
Figure 4:
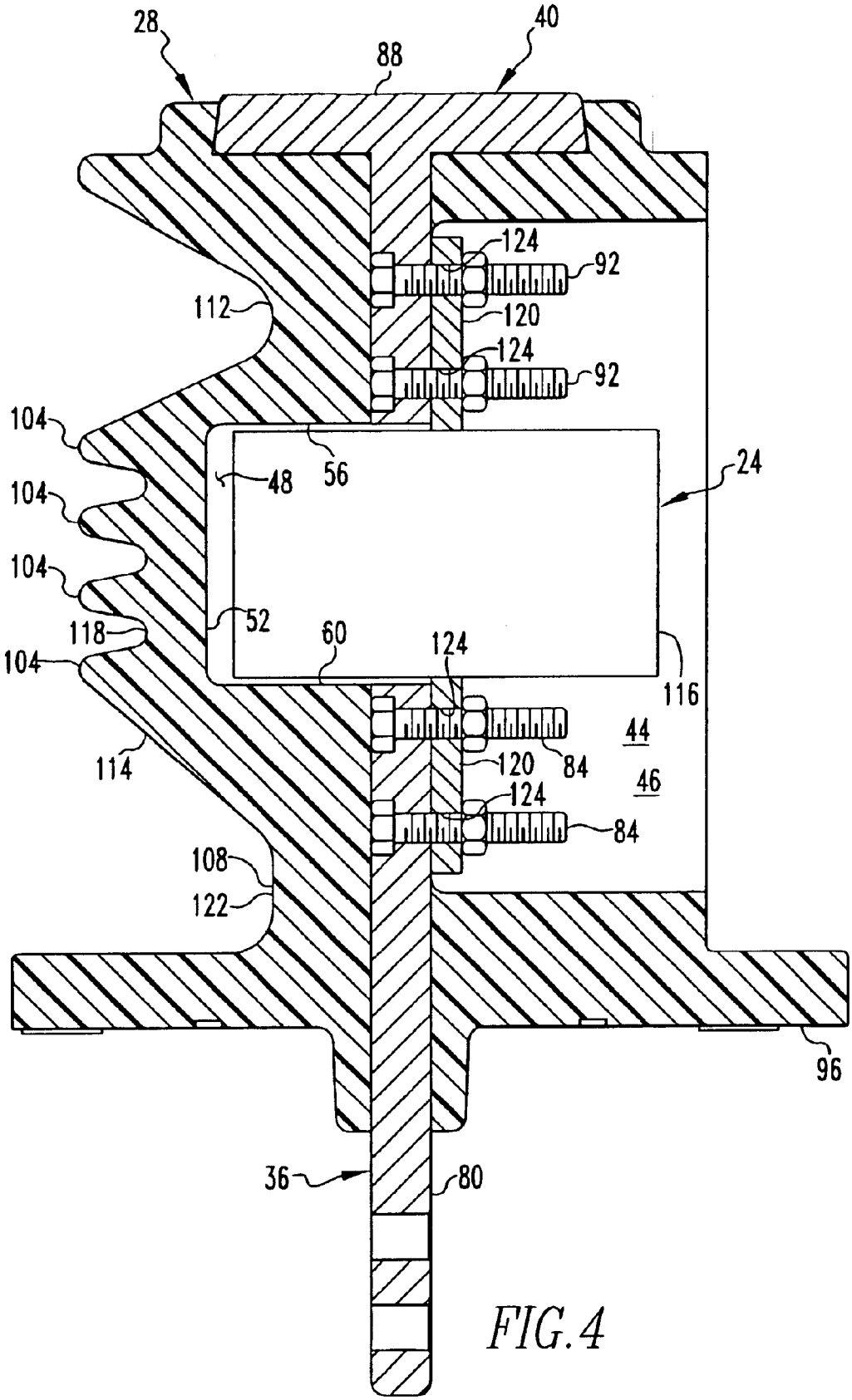
FIG. 4 is a sectional view as taken along line 4—4 of FIG. 3.

As can be understood from FIGS. 1 and 2, the current interrupter 16 includes an improved fuse housing 20 in accordance with the present invention and a fuse 24. The fuse housing 20 includes a main body 28, a cover 32 (FIG. 1), a first conductor 36 (FIGS. 3 and 4), and a second conductor 40 (FIGS. 3 and 4). The main body 28 and the cover 32 are molded out of an insulative material such as plastic or epoxy, although other formation techniques and materials may be employed. The first and second conductors 36 and 40 are molded into the material of the main body 28, meaning that the first and second conductors 36 and 40 are pre-formed and are initially held in a given position in the mold from which the main body 28 is formed. The material out of which the main body 28 is to be formed is then injected into the mold and flows around the first and second conductors 36 and 40 and hardens with the first and second conductors 36 and 40 being retained in such position.

The main body 28 includes a cavity 44 formed therein. The cavity 44 is configured to receive the fuse 24 therein. As can be understood from FIGS. 3 and 4, the ends of the first and second conductors 36 and 40 protrude into the cavity 44 for connection with the fuse 24. The cavity 44 includes a main region 46 and a void region 48, with the main region 46 being in communication with the atmosphere when the cover 32 is removed from the main body 28. The void region 48 is in communication with the main region 46.

As can be seen from FIGS. 3 and 4, the void region 48 includes a base surface 52 opposite the main region 46, plus a top lateral surface 56 (FIG. 4), a bottom lateral surface 60

(FIG. 4), a left lateral surface 64 (FIG. 3), and a right lateral surface 68 (FIG. 3). It can be seen that the top, bottom, left, and right lateral surfaces 56, 60, 64, and 68 each extend between the base surface 52 and the main region 46. It can also be seen that the base surface 52 and the top, bottom, left, and right lateral surfaces 56, 60, 64, and 68 together generally define the void region 48.

The main body 28 also includes a plurality of sockets 72 for fastening the cover 32 to the main body 28. The sockets 72 may be any of a wide variety of structures that enable the cover 32 to be attached to the main body 28. In this regard, the sockets 72 may each be threaded nuts that are embedded in the main body 28 and that are co-operable with a plurality of threaded fasteners such as screws or bolts. It is understood, however, that the sockets 72 may be of other configurations such as female bayonet fittings, or may simply be holes that are cooperable with self-tapping screws. Additionally, the sockets 72 may be formed in the cover 32 instead of the main body 28. The sockets 72 are depicted in FIG. 3 in a schematic form, meaning that they can be of numerous different configurations depending upon the specific needs of the particular application.

It can be seen that the main body 28 includes a total of twelve sockets 72 for use in connecting the cover 32 with the main body 28. It can further be seen that some of the sockets 72 are disposed in lugs 76 formed in the main body 28. The lugs 76 are configured to permit forces to be transmitted from the main body 28 to the cover 32 without fracturing the main body 28.

As can be understood from FIGS. 3 and 4, the first conductor 36 includes a first bus 80 and a plurality of studs 84. The first bus 80 extends between the void region 48 and the exterior of the fuse housing 20 and is configured to be connected with the fuse 24 via the studs 84. In the present embodiment, the studs 84 are fixedly mounted to the first bus 80 such as by casting the material of the first bus 80 around the studs 84, although other attachment methodologies and degrees of fixation may be employed.

The studs 84 are, in the present embodiment, threaded conductive members that can be mounted to the fuse 24 with cooperative nuts. It is understood, however, that the studs 84 may be other types of fasteners, such as non-threaded fasteners, without departing from the concept of the present invention. As is best shown in FIG. 3, the first conductor 36 includes six of the studs 84 mounted on the first bus 80. The studs 84 are all disposed within the cavity 44. Although not specifically shown in the accompanying drawings, the first bus 80 connects between the fuse 24 and the load terminals of the circuit breaker 12.

The second conductor 40 includes a second bus 88 and a plurality of studs 92. The second conductor 40 is generally T-shaped, and the studs 92 are fixedly mounted on the second bus 88. The second conductor 40 includes six of the studs 92 mounted on the second bus 88. The studs 92 are virtually identical to the studs 84 of the first conductor 36. The studs 92 are all disposed within the cavity 44 and are configured to be connectable with the fuse 24. Although not specifically shown in the accompanying figures, the second bus 88 is configured to connect between the fuse 24 and a conduction member (not shown) that extends to the network. As with the first conductor 36, the studs 92 may be fixedly mounted in the second bus 88 by casting the material of the second bus 88 around the studs 92, although other attachment methodologies and degrees of fixation may be employed without departing from the concept of the present invention.

As can be seen in FIGS. 3 and 4, the main body 28 includes a base 96 defined thereon including a plurality of mounting holes 100. Appropriate fasteners protrude outwardly from the enclosure 8 and extend through the mounting holes 100 for cooperation with appropriately configured nuts or other fasteners. The base 96 serves as a mount for mounting the fuse housing 20 to another structure, such as the enclosure 8. It is understood, however, that different attachment methodologies may be employed to mount the base 96 of the main body 28 onto the enclosure 8. It is further understood that in other embodiments (not shown) of the present invention, the fuse housing 20 may be mounted to a structure other than the enclosure 8, such as a wall of a containment vessel, and potentially may not be mounted to any structure at all, and rather be floatingly mounted between the first and second conductors 36 and 40.

As is best shown in FIG. 4, the main body 28 includes a plurality of fins 104 formed thereon. While in the present embodiment of the fuse housing 20 of the present invention the fins 104 are monolithically formed as a single-piece member with the main body 28, it is understood that in other embodiments (not shown) the fins 104 potentially may be separately manufactured and attached to the main body 28. In this regard, it is understood that the term "monolithically" and variations thereof refers to a construction that is substantially free of joint.

The fins 104 advantageously promote the transfer of heat from the main body 28 to the surrounding atmosphere by increasing the surface area of the main body 28 and thus enhancing heat transfer therefrom, including convective heat transfer to the surrounding atmosphere.

As can further be seen from FIG. 4, the main body 28 includes a first depression 108 that is disposed generally between the base 96 and the set of fins 104. Similarly, the main body 28 further includes a second depression 112 on the opposite side of the fins 104 from the first depression 108. The first and second depressions 108 and 112 serve to further increase the surface area of the main body 28 and thus promote heat transfer from the main body 28, including convective heat transfer to the surrounding atmosphere.

It can be seen that the main body 28 forms a projection 114 between the first and second depressions 108 and 112, and that the fins 104 are disposed on a free end 118 of the projection 114. The projection 114 extends laterally outward from a side wall 122 (FIG. 4) of the main body 28. In the embodiment of the main body 28 depicted herein, the side wall 122 is defined by the first and second depressions 108 and 112. The projection 114 is generally wedge-shaped or tapered, and the void region 48 extends partially into the projection 114. By forming the void region 48 in the projection 114, the quantity of material of the main body 28 that is interposed between the fuse 24 and the exterior atmosphere is less than that of previously known fuse housings, which advantageously increases the rate at which heat is transferred away from the fuse 24.

It thus can be seen that the fins 104 and the first and second depressions 108 and 112 together increase the surface area of the main body 28 and thus enhance the transfer of heat from the fuse housing 20 such as by convective heat transfer to the surrounding atmosphere, which helps to dissipate the heat generated by current passing through the fuse 24. As such, the fins 104 and the first and second depressions 108 and 112 permit the current interrupter 16 to handle relatively greater current levels.

The fuse 24 can be seen to include a substantially cylindrical fuse body 116 and a pair of connection plates 120. The connection plates 120 are generally coplanar and extend from the opposite circular end surfaces of the fuse body 116. Each of the connection plates 120 is formed with a plurality of holes 124 that are configured to receive either the studs 84 or the studs 92.

The relatively large number of holes 124 for connection with the studs 84 or the studs 92 provide an enhanced mechanical connection between the connection plates 120 and the first and second buses 80 and 88, which promotes conduction of heat from the fuse body 116 to the first and second buses 80 and 88 and thence to the main body 28 for enhanced dissipation via the fins 104 and the first and second depressions 108 and 112. While in many application the connection plates 120 might not necessarily each require six mechanical connections in order to form an electrically conductive connection, the large number of mechanical connections therebetween afforded by the holes 124 and the first and second buses 80 and 88 advantageously promotes an enhanced thermally conductive connection between the connection plates 120 and the first and second buses 80 and 88. As such, the configuration of the holes 124 and the first and second buses 80 and 88 provides an additional level of heat dissipation from the fuse 24, which further increases the current carrying capacity of the current interrupter 16.

It can be seen that at least a portion of the fuse body 116 protrudes into the void region 48 of the cavity 44. It can further be seen that the fuse body 16 is disposed substantially closer to the top and bottom lateral surfaces 56 and 60 than to the base surface 52. It is known in the relevant art that air between the fuse body 116 and the main body 28 serves as an insulator which resists the transfer of heat therebetween. As such, by minimizing the distance between the fuse body 116 and the top and bottom lateral surfaces 56 and 60, the amount of insulative air therebetween is likewise reduced, which enhances the transfer of heat from the fuse body 116 to the main body 28, after which the heat is dissipated by the fins 104 and the first and second depressions 108 and 112. In fuses 24 having different current ratings, the distance of the fuse body 116 to the base surface 52 may vary, but the space between the fuse body 116 and the top and bottom lateral surfaces 56 and 60 generally will remain unchanged, which allows for a consistent and predictable level of heat transfer between the fuse body 116 and the top and bottom lateral surfaces 56 and 60 to the main body 28.

The close spacing of the fuse body 116 to the top and bottom lateral surfaces 56 and 60, the distance which is less than the distance from the fuse body 116 to the base surface 52, increases the heat transfer from the fuse body 116 to the main body 28, which correspondingly enhances the current-carrying capacity of the current interrupter 16. It is understood that since the surface of the fuse body 116 that faces the base surface 52 is generally arcuate and thus faces also toward the left and right lateral surfaces 64 and 68. As such, heat from the arcuate surface will be transferred to the base surface 52 as well as the left and right lateral surfaces 64 and 68. Accordingly, reference herein to the distance between the fuse body 116 and the base surface 52 refers more particularly to an aggregate distance, i.e., an average distance between the arcuate surface and the generally planar base surface 52 and the left and right lateral surfaces 64 and 68.

As can be understood from the accompanying figures, the cover 32 is fastened to the main body 28 by employing twelve fasteners that are cooperable with the sockets 72. It is understood that in most applications of the current interrupter 16, twelve such fasteners and sockets 72 may not be strictly necessary to simply seal the fuse 24 within the cavity 44. Nevertheless, by providing such a relatively large number of mechanical connections between the cover 32 and the main body 28, the cover 32 is substantially transformed into a covering member that also functions as a structural member of the fuse housing 20. In this regard, by securely fastening the cover 32 to the main body 28 with the fasteners that cooperate with the sockets 72, forces or torques that are applied to the main body 28 will be, in turn, transmitted to the cover 32, whereby any such forces and torques are distributed throughout the fuse housing 20 instead of being concentrated in the main body 28. In such fashion, the fuse housing 20 is able to withstand greater levels of forces and torques than if the cover 32 were mounted to the main body 28 with only a minimal number of fasteners and sockets 72. Accordingly, the current interrupter 16 is capable of structurally handling relatively greater current loads since it is advantageously capable of withstanding forces and torques that may be induced in the first and second conductors 36 and 40 as a result of such elevated current loads.

It thus can be seen that the improved fuse housing 20 that is employed in the improved current interrupter 16 is generally capable of handling a greater current load than previously known systems, which accordingly increases the current capacity of the improved network protector 4 that incorporates the current interrupter 16. As set forth above, the fuse housing 20 includes various improvements which both thermally and structurally enable the current interrupter 16 to carry greater current loads.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A network protector comprising:

an enclosure;

first current interruption means disposed internally within the enclosure;

second current interruption means disposed externally of the enclosure;

the second current interruption means including a fuse;

the second current interruption means including a fuse housing;

the fuse housing including a main body having an axial dimension and a lateral dimension and an inside surface and an outside surface;

said main body having two lateral depressions axially spaced along said main body with a raised lateral projection disposed there between;

the raised projection having an internal cavity on the inside surface thereof;

the fuse being disposed in a portion of the internal cavity;

the main body including at least a first fin disposed on said outside surface of the raised projection; and the at least first fin being structured to dissipate heat from the fuse housing to the atmosphere.

2. The network protector of claim 1 wherein said projection is wedge shaped.

* * * * *